US006449451B2

(12) United States Patent
Tsuruya et al.

(10) Patent No.: US 6,449,451 B2
(45) Date of Patent: Sep. 10, 2002

(54) IMAGE FORMING APPARATUS

(75) Inventors: Satoshi Tsuruya, Mishima; Jun Suzuki, Numazu, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/740,878

(22) Filed: Dec. 21, 2000

(30) Foreign Application Priority Data

Dec. 24, 1999 (JP) ..... 11-368090

(51) Int. Cl.[7] ..... G03G 15/01

(52) U.S. Cl. ..... 399/223; 399/299; 399/302; 399/303

(58) Field of Search ..... 399/223, 224, 399/227, 298, 299, 301–303

(56) References Cited

U.S. PATENT DOCUMENTS 5,799,230 A * 8/1998 Lloyd ..... 399/223 X
6,253,038 B1 * 6/2001 Ito et al. ..... 399/302 X
6,317,147 B1 * 11/2001 Tanaka ..... 399/301 X

* cited by examiner

*Primary Examiner*—William J. Royer
(74) *Attorney, Agent, or Firm*—Fitzpatrick, Cella, Harper & Scinto

(57) ABSTRACT

The present invention provides an image forming apparatus that has a plurality of image bearing members for bearing developer images thereon, and a plurality of developer containing portions for containing developers therein and provided correspondingly to respective ones of the plurality of image bearing members, wherein the developer images can be transferred from the plurality of image bearing members to a transferring member moving along the respective transferring positions of the plurality of image bearing members, and of the plurality of developer containing portions, a developer containing portion having greatest developer containing quantity is provided at least one of upstream of the most upstream one of the plurality of image bearing members and downstream of the most downstream one of the plurality of image bearing members, with respect to a moving direction of the transferring member.

14 Claims, 8 Drawing Sheets

IMAGE FORMING APPARATUS

BACKGROUND OF THE INVENTION

1. Field of the Invention

This invention relates to an image forming apparatus utilizing the electrophotographic recording method, such as a laser printer, a copier or a facsimile apparatus, and particularly to an image forming apparatus provided with a plurality of image bearing members and suitable for use in the in-line method wherein images formed on the image bearing members are sequentially superimposed on the same transferring member to thereby form images of a plurality of colors.

2. Related Background Art

Various color image forming apparatuses utilizing the electrophotographic recording method to form images of a plurality of colors have heretofore been devised and some of them have been put into practical use.

The image forming apparatuses of the electrophotographic recording type are excellent in that the recording speed can be made high, over image forming apparatuses of other recording types such as the ink jet type in which ink droplets are directly blown against recording paper to thereby form an image, and the silver salt photographic type in which image exposure is effected on a photosensitive chromophoric material to thereby effect recording, and are achieving distinction from those other recording types for the market needs desiring a higher speed.

As a typical example of color image forming apparatuses utilizing the electrophotographic recording method, there is, for example, a color image forming apparatus of a type containing a rotatable developing apparatus therein. The color image forming apparatus of this type is provided with a rotatable body (rotatable developing apparatus) therein, and has an apparatus construction in which developing devices of four colors, e.g. yellow, magenta, cyan and black, are disposed along the rotational peripheral surface of the rotatable body, whereby electrostatic latent image bearing bodies (photosensitive bodies) are sequentially developed with developers (toners) of the respective colors.

In the image forming apparatus adopting such a rotatable developing apparatus, the step of visualizing electrostatic latent images for the respective colors formed on a common photosensitive body as toner images at a predetermined developing position by the respective developing devices, and transferring such toner images onto sheet-like recording paper (transferring material) such as paper each time the toner image is obtained is repeated. By the repetition of such transferring step, toner images of a plurality of colors are formed.

Also, as another example, there has been devised an apparatus of a type in which toner images of respective colors are sequentially selectively superimposed on the surface of a photosensitive body to thereby form toner images of a plurality of colors on the surface of the photosensitive body, whereafter the toner images are collectively transferred to recording paper.

There is also an image forming apparatus of the so-called in-line type in which by the use of a plurality of photosensitive bodies, toner images of respective colors are discretely formed by developing devices of the respective colors, and the toner images are sequentially transferred from the respective photosensitive bodies onto a transferring member and the transferring member is conveyed to thereby form toner images of a plurality of colors.

There is also a type in which toner images of respective colors are sequentially superimposed not directly on recording paper but on an intermediate transferring member (transferring member) to thereby form toner images of a plurality of colors, whereafter the toner images are collectively transferred to the recording paper.

The above-described typical types of the color image forming apparatus utilizing the electrophotographic recording method have both merits and demerits, but from the viewpoint of the higher speed progressing conjointly with the recent market needs, the in-line type is at advantage and many products have been put into practical use by this type.

FIG. 9 of the accompanying drawings is a side view schematically showing an example of the image forming apparatus adopting the in-line type, more particularly the main internal construction of an image forming apparatus of a four-drum multiple transfer type (hereinafter referred to as the in-line color printer).

The in-line color printer 400 has photosensitive drums which are electrostatic latent image bearing members disposed in opposed relationship with developing devices containing toners of respective colors therein and successively disposed in the direction of conveyance of a transferring member, and sequentially transfers toner images of the respective colors developed on the respective drums by the developing devices to recording paper conveyed by a transferring belt or the like, and obtains a full color image by toners of four colors, i.e., yellow, magenta and cyan which are three primary colors, plus black.

In FIG. 9, an endless transferring belt 406 is passed over a driving roller 407 and a driven roller 410, and is rotated in the direction of arrow, and four photosensitive drums 401*a* to 401*d* are disposed in series in opposed relationship with the transferring belt 406. Generally, to obtain a high quality of image in the apparatus of this type, it is important to reduce the color misregistration among the images of a plurality of colors formed by superimposition, and it is preferable to make the station spacings among a plurality of image forming means (image forming stations), in other words, the spacings among the photosensitive bodies, equal to each other, and the disposition accuracy thereof is important.

It is also effective for the reduction in color misregistration to make the circumferential length of the driving roller and the spacings among the photosensitive bodies equal to each other.

Also, the image forming stations 409*a*, 409*b*, 409*c* and 409*d* for forming images of respective colors are comprised of photosensitive drums 401*a* to 401*d*, charging apparatuses 402*a* to 402*d*, exposing apparatuses 403*a* to 403*d*, developing devices 404*a* to 404*d* and cleaning apparatuses 405*a* to 405*d*, and these are disposed around the respective photosensitive drums.

In the image forming stations 409*a*, 409*b*, 409*c* and 409*d*, developer images of the respective colors are superimposed on a recording material conveyed on the transferring belt 406 by yellow (Y), magenta (M), cyan (C) and black (Bk) developers to thereby form a multicolored image. Also, the image forming stations of the respective colors have constructions substantially similar to one another with the exception that the developers of different colors are contained in the developer containing portions of the developing devices 404*a* to 404*d*.

The image forming operation will hereinafter be described. A laser beam (information light including predetermined image information) modulated in conformity with image data from a host apparatus such as a personal computer is applied from the exposing apparatuses 403*a* to 403*d* to the surfaces of the photosensitive drums 401*a* to 401*d* uniformly charged by charging rollers which are charging apparatuses 402*a* to 402*d*, whereby desired electrostatic latent images are obtained for the respective colors. These latent images are reversal-developed on the predetermined developing regions of the rotational peripheral surfaces of the photosensitive drums by the developing devices 404*a* to 404*d* disposed in opposed relationship with the aforementioned predetermined developing regions and containing toners of the respective colors therein, and are visualized as toner images. These toner images are electrostatically multiplexly transferred in order of Y, M, C and Bk in transferring nip portions by the transferring apparatuses 408*a* to 408*d* to recording paper P fed by a paper feeding mechanism, not shown, i.e., the recording paper P conveyed by a conveying mechanism and entering from the right as viewed in FIG. 9, and a resultant color toner image is melted and fixed by a fixing apparatus, not shown, and is permanently fixed on the recording, paper whereby a desired color print image is obtained.

When a monochromatic image of a single color Bk is to be formed, the image forming means of the other colors than Bk are not operated, and a similar image forming operation is performed with the transferring belt 406 and the photosensitive drums 401*a* to 401*c* being spaced apart from each other by a mechanism, not shown.

Also, after the transfer, any toners not transferred but residual on the photosensitive drums 401*a* to 401*d* are removed by the cleaning apparatuses 405*a* to 405*d* such as cleaning blades, and the photosensitive drums are prepared for the next image forming process.

Also, with regard to the developing method, generally any of the method of contact and the method of non-contact with the photosensitive drums may be applied to the in-line color printer, and the toners which are the developers may be of any of the monocomponent type and the two-component type. As an example, mention may be made of the contact developing method by a non-magnetic monocomponent toner.

In the in-line color printer 400 of FIG. 9, the image forming stations 409*a* to 409*d* form process cartridges in which the photosensitive drums 401*a* to 401*d*, the charging apparatuses 402*a* to 402*d*, the developing devices 404*a* to 404*d* and the cleaning apparatuses 405*a* to 405*d* are made integral with one another and which are detachably attachable to the main body of the in-line color printer 400.

For example, FIG. 10 of the accompanying drawings enlargedly shows a process cartridge (image forming station) 409*a* for effecting the development by the yellow (Y) toner among the process cartridges shown in FIG. 9. Incidentally, the other process cartridges 409*b* to 409*d* for M, C and Bk have the same form and function as those of the process cartridge 409*a* with the exception that the colors of the developers (toners) contained therein differ from one another.

The in-line color printer 400 of the present example has means for detecting the amount of residual toner in each process cartridge, and when the toner in the cartridge of a certain color has become exhausted and that cartridge has reached its life, it is possible for the user to continuedly use the printer simply by interchanging that process cartridge, and such maintenance by a servicemen that is effected in a copier or the like is unnecessary.

There is also the advantage that the image forming stations form the process cartridges, whereby good images free of any inconvenience can always be stably obtained until the life of the process cartridges expires, the user can easily effect the interchange of the process cartridges.

Now, when a market research regarding the user's actual use of color image forming apparatuses of the electrophotographic type has been done, it has been confirmed that printed images include various images such as pictorial full color images like photographs, one-point business color images having colors partially attached to portions to be emphasized, and monochromatic images, but the consumption of the black toner is great when viewed in terms of the total quantity of used toners.

Further, there is a demand for minimizing the cost per sheet during the printing of monochromatic images.

However, when as in the apparatus shown in FIG. 9, the quantities of toners in the developing devices are all the same, the frequency of the interchange of the Bk process cartridge is high, and this is cumbersome and leads to a problem in maintenance.

Also, when the image forming means are not in the form of process cartridges, the interchange of the photosensitive drums and the interchange of the charging apparatuses, the developing devices or the toner containers are effected discretely from each other, and the frequency of maintenance becomes still higher.

On the other hand, to form images of high quality stably in various environments, it is necessary to sufficiently agitate and circulate the toners in the developing devices. If there is a problem in the agitation of the developers or the conveyance of the developers to the developing portions, there will arise such a phenomenon that the developers stagnate or adhere and lump (block) and thus, irregular density or streaks will occur to outputted images.

Particularly, when the quantities of developers in the developing devices are to be increased, it is necessary to care about this point.

In view of these points, it would occur to mind to horizontally enlarge the width of the container of the developing device 404*d* of the image forming station 409*d* (Bk) shown, for example, in FIG. 9, so as to make the quantity of the toner contained in the developing device 404*d* great relative to the quantities of the toners of the other colors, but this would widen the distance between adjacent ones of the image forming stations, and would make the in-line color printer 400 itself bulky.

Also, in terms of the quality of image, when the correction of the above-mentioned color misregistration and the ease of the control of the image forming apparatus are taken into consideration, equidistance is ideal as the distance between the stations and to prevent the entire apparatus from becoming bulky, it is preferable that the distance between the image forming stations be as short as possible.

Conversely, it would also occur to mind to extend the container along the direction of gravity (a direction perpendicular to the direction of conveyance of the recording paper), but in this case, it will become difficult to agitate the developer sufficiently, and the so-called packing state that is, the phenomenon that the underlying toner is crushed by the weight of the overlying toner and becomes clogged and hardened, will become liable to occur. Thus, when the adverse effect on images and the disposition of the exposing apparatus 403*d* are taken into consideration, the extension of the container along the direction of gravity is neither very preferable.

SUMMARY OF THE INVENTION

It is an object of the present invention to provide an in-line type image forming apparatus which is low in running cost and easy to maintain.

It is another object of the present invention to provide an in-line type image forming apparatus which prevents a reduction in quality of image and is restrained from becoming bulky even when the capacity of a developer containing portion containing therein a developer of a particular color used in a great deal is made large relative to that of other colors.

It is still another object of the present invention to provide an image forming apparatus which is provided with a plurality of image bearing members and is easy to control and in which it is difficult for the color misregistration of an image to occur.

DESCRIPTION OF THE PREFERRED EMBODIMENTS

[First Embodiment]

A first embodiment in which the image forming apparatus of the present invention is applied to an in-line type color image forming apparatus will hereinafter be described with reference to the drawings.

Figure 1:
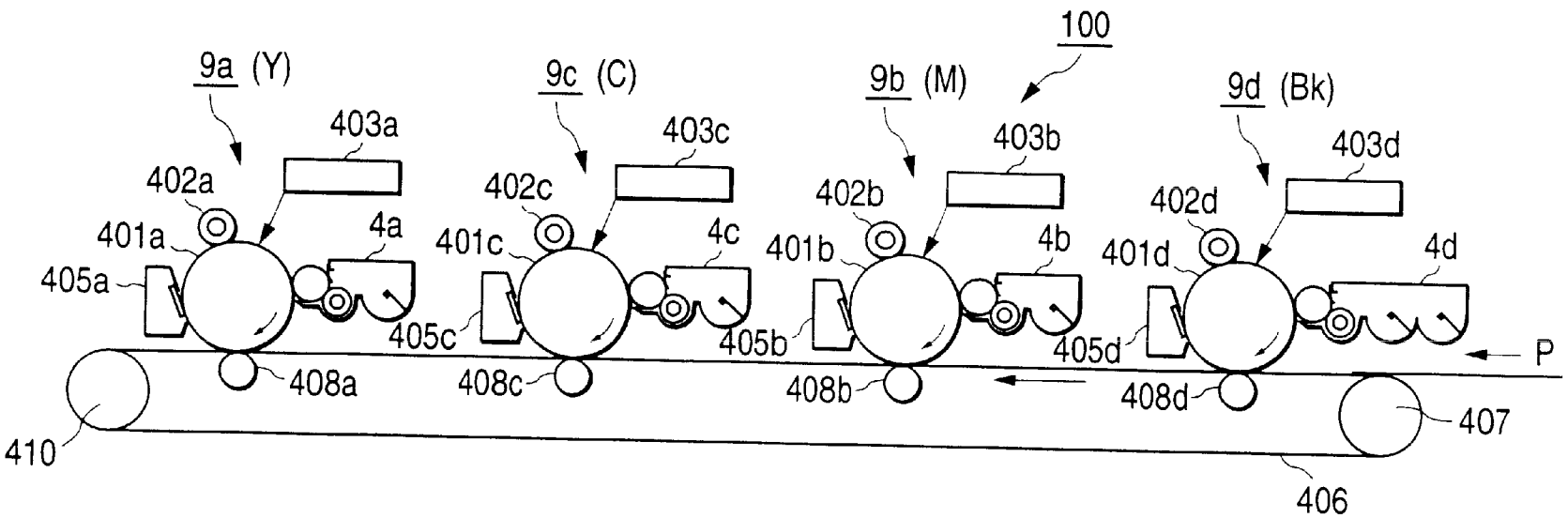
FIG. 1 is a side view schematically showing the main internal structure of an in-line color printer according to a first embodiment of the present invention.
Figure 9:
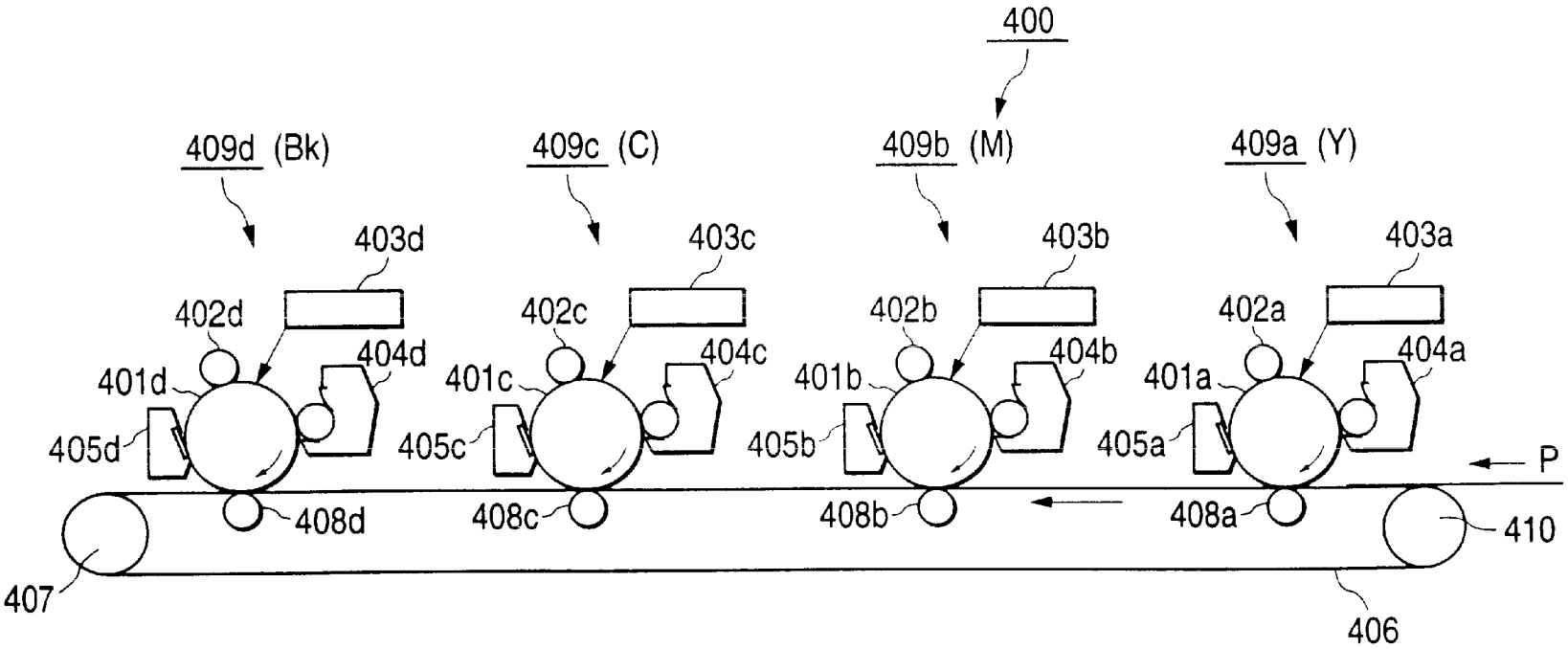
FIG. 9 PRIOR ART
FIG. 9 is a side view schematically showing a prior-art color image forming apparatus adopting the in-line method.
Figure 10:
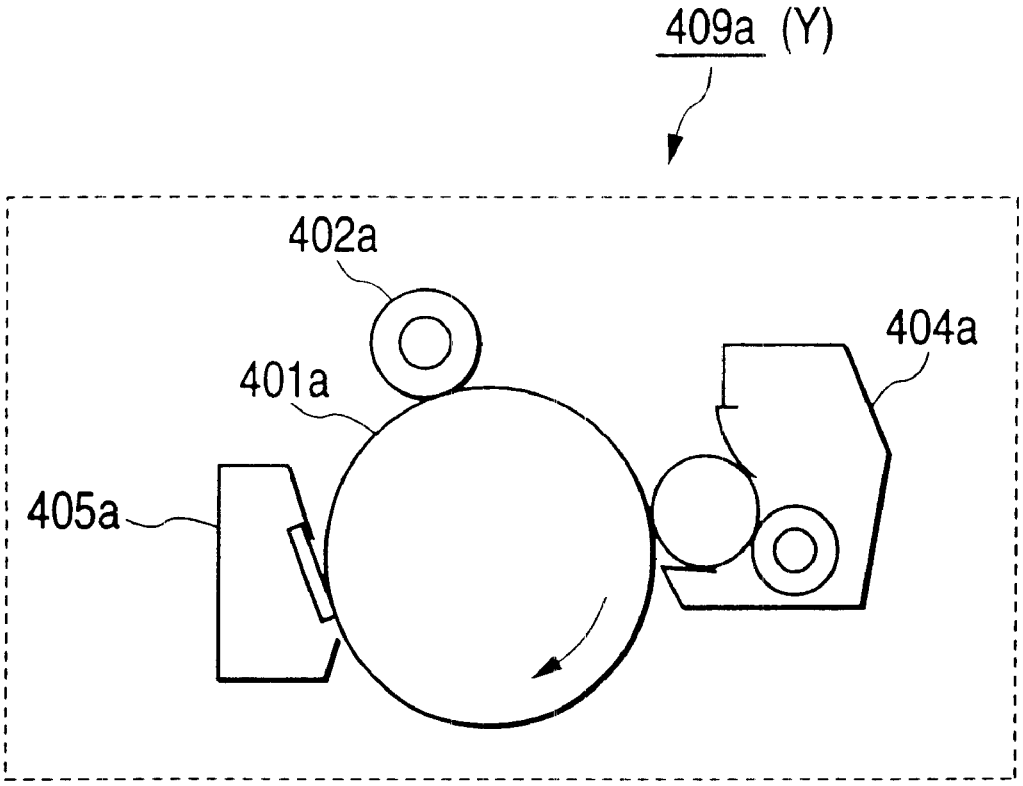
FIG. 10 PRIOR ART
FIG. 10 is a side view showing the process cartridge of the same apparatus on an enlarged scale.

FIG. 1 is a side view schematically showing the main internal structure of an in-line type color image forming apparatus (in-line color printer) 100 according to the present embodiment. The in-line color printer according to the present embodiment is equal in the basic constructions thereof to the in-line color printer 400 (see FIG. 9) described in the prior art, and those equal basic constructions need not be described.

As shown in FIG. 1, the in-line color printer 100 is substantially the same in the basic constructions thereof as the prior-art in-line color printer 400 with the exception that an image forming station 9*a* (Y) and an image forming station 9*d* (Bk) are constructed with their positions changed from those in the in-line color printer 400 (FIG. 9), and the basic operation concerned in image formation is executed in a similar mode.

The construction and function of image forming stations 9*a* to 9*d* in the present embodiment for forming yellow (Y), magenta (M), cyan (C) and black (Bk) images on recording paper will now be described in detail with reference to FIGS. 2 and 3.

Again in the apparatus according to the present embodiment, the image forming stations 9*a* to 9*d* for respective colors are comprised of photosensitive bodies 401*a* to 40*d*, charging apparatuses 402*a* to 402*d*, exposing apparatuses 403*a* to 403*d*, developing devices 4*a* to 4*d* and cleaning apparatuses 405*a* to 405*d*. The respective image forming stations 9*a* to 9*d* are successively disposed along a transferring belt 406, i.e., on the conveying path of the recording paper (transferring member) P, as process cartridges made integral and detachably attachable to the image body of the in-line color printer 100.

Figure 2:
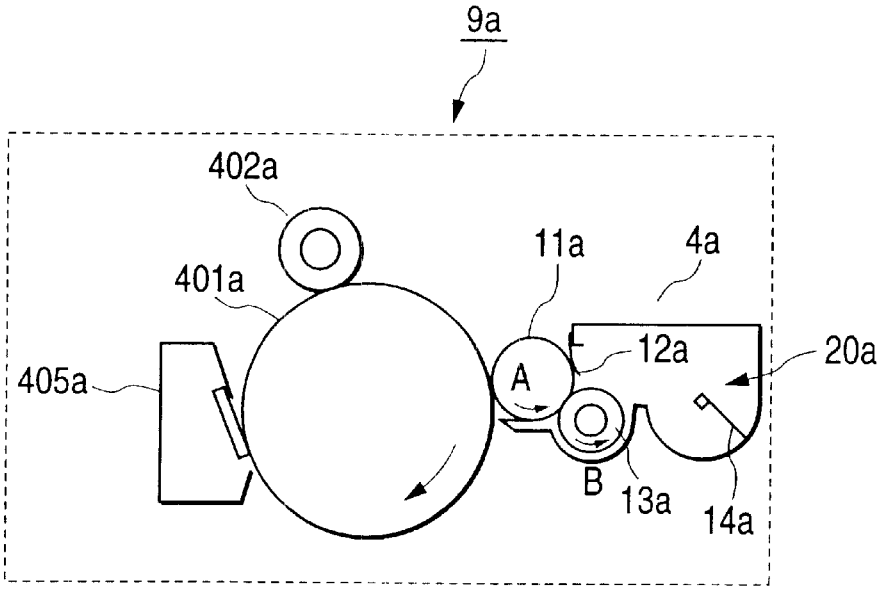
FIG. 2 is a side view showing the process cartridge of the in-line color printer according to the same embodiment on an enlarged scale.
Figure 3:
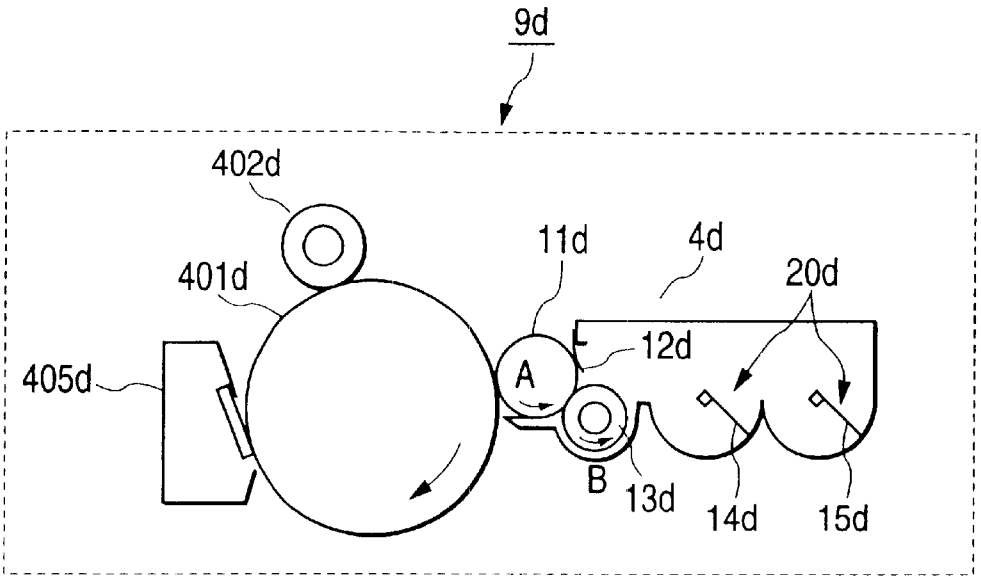
FIG. 3 is a side view showing the process cartridge of the in-line color printer according to the same embodiment on an enlarged scale.

FIGS. 2 and 3 show the constructions of the process cartridges 9*a* and 9*d* in detail.

The process cartridges 9*a*, 9*b* and 9*c* are substantially equal in construction and function to one another with the exception that they are mechanisms for forming images by developers of different colors. So, in FIG. 2, only the process cartridge 9*a* will be described and the other process cartridges 9*b* and 9*c* need not be described.

First, as shown on an enlarged scale in FIG. 2, for example, the developing device 4*a* is comprised of a developing sleeve 11*a*, a blade 12*a*, an RS roller (developer supplying roller) 13*a* and a toner carrying member 14*a*. Also, the Y, M and C developing devices 4*a*, 4*b* and 4*c* are equal in structure to one another as well-known monocomponent contact developing devices with the exception that they contain developers of different colors therein. When so-called development is to be effected by these developing devices 4*a* to 4*c*, a monocomponent non-magnetic toner (developer) to which triboelectricity (a charging amount) has been imparted is carried out toward the photosensitive body 401*a* while being held as a thin layer on the surface of the developing sleeve 11*a*, by the rotation of the developing sleeve 11*a* in the direction of arrow A and the regulating operation of the blade 12*a*. In a developing region contacting with the photosensitive body 401*a* which is an electrostatic latent image bearing member, a predetermined bias voltage is applied to this developer in its thin layer state, whereby the electrostatic latent image on the photosensitive body 401*a* is developed as a toner image.

The RS roller 13*a* for supplying the sleeve with the developer carried from a developer containing portion side abuts against the sleeve and is rotated in a counterclockwise direction (the direction of arrow B). The RS roller 13*a* also serves to scrape off the residual toner on the sleeve after development, and prevents the toner from stagnating on the sleeve and being deteriorated.

In the developing device 4*a*, the developer is contained in a developer containing portion 20*a* for containing the developer, and the toner carrying member 14*a* is disposed to supply the developer to the developing region side. The toner carrying member 14*a* supplies the toner by the rotation thereof and also serves to agitate and mix the developer scraped off by the RS roller 13 and the developer in the developing device 4*a* together to thereby prevent a particular developer from being deteriorated.

Next, as shown on an enlarged scale in FIG. 3, the developing device 4*d* for the Bk developer in the present embodiment is constructed so that the volume of the developer containing portion 20*d* thereof may be great relative to the above-described Y, M and C developing devices 4*a*, 4*b* and 4*c* so as to be capable of containing about double the amount of developer therein. By such a construction, the life of the Bk process cartridge 9*d* can be made about double and the frequency of interchange can be reduced.

The image forming apparatus according to the present embodiment can select a black monochrome mode in which a black monochrome image can be formed, and a one-point color mode in which an image of another color can be put into a portion of a black image, and often consumes the black toner earlier than the toners of the other colors.

The other sections of the developer containing portion 20*d* in the Bk developing device 4*d* are similar in construction to those in the developing devices 4*a* to 4*c* of the other colors. Also, the Bk developer containing portion is of a construction in which the above-described toner carrying member 14*d* and in addition, another similar toner carrying member 15*d* are juxtaposed and therefore, even if the life is extended by the quantity of the toner being increased, no problem will arise in the conveyance and agitation of the developer, and abnormal images can be prevented from being created.

In the present embodiment, the Bk process cartridge containing therein more developer relative to the other colors is disposed on the upstream side with respect to the conveying direction of the transferring belt 406, i.e., the end portion side of the conveying path, and the Bk developer containing portion has its volume (the width of the developer containing portion) extended toward the upstream side which is a similar direction, i.e., the end portion side of the conveying path, so as not to be disposed between image forming means (on the M image forming station side).

Accordingly, the photosensitive bodies of the respective stations can be disposed at equal intervals without the interval between adjacent ones of the process cartridges being widened, and it never happens that such control as the correction of color registration is made cumbersome. Also, if the interval between adjacent ones of the photosensitive bodies is made integer times as great as the circumferential length of the driving roller of the transferring belt 406, it will become difficult for color unevenness of an image to occur, and this is preferable.

Figure 4:
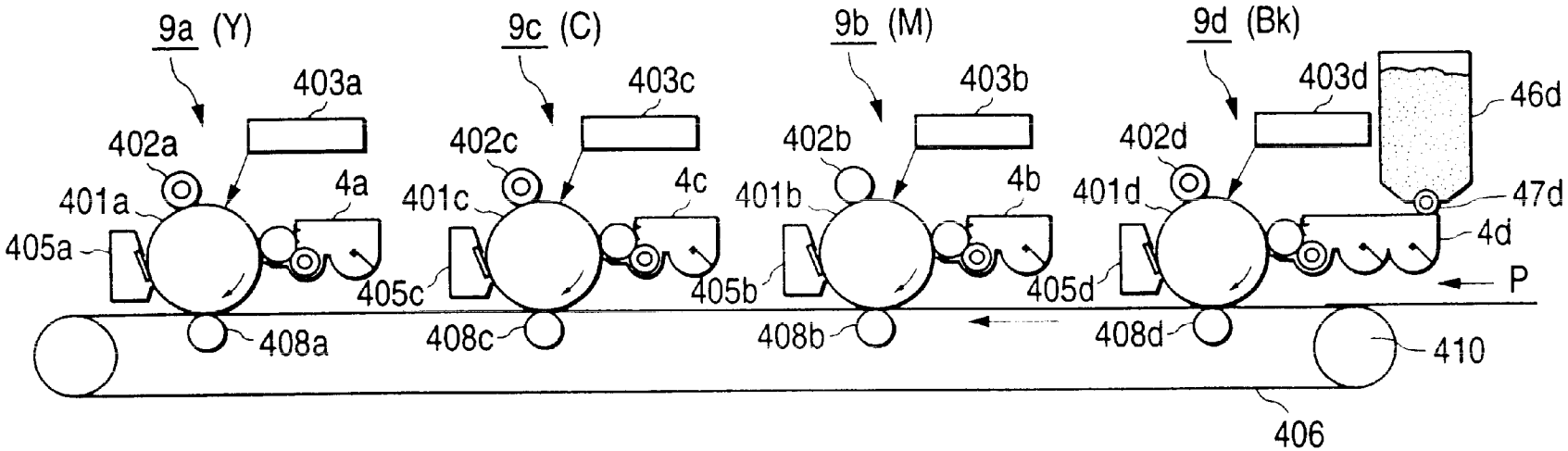
FIG. 4 is a side view schematically showing the main internal structure of a modification of the in-line color printer according to the same embodiment.

Here, as shown, for example, in FIG. 4, only the Bk developing device can be made into a so-called replenishing system type construction.

That is, the Bk developing device 4*d* can be made into a construction which is additionally provided with a developer supplying container 46*d* containing therein a developer to be supplied and in which a predetermined quantity of developer is supplied to the developer containing portion 20*d* at suitable timing through the developer supply opening (not shown) of a replenishing mechanism 47*d*.

On the other hand, while in the present embodiment, the Bk developer containing portion 20*d* has been described as containing therein a toner which is about double the amount of developer relative to a plurality of colors, the film thickness of the photosensitive layer of the photosensitive body for black may be correspondingly increased relative to that for the other colors.

Describing in detail, the photosensitive bodies 401*a* to 401*d* used in the present embodiment are so-called organic photosensitive bodies in each of which an undercoat layer is provided on a mandrel formed of aluminum, and a charge generating layer formed of a phthalocyanine compound is formed thereon and further, a charge transporting layer having an aryl amine compound dispersed as a binder in polycarbonate is formed on the upper layer thereof.

So, as regards the film thickness of the charge transporting layer on the surface of the photosensitive body, the calculation of the amount of scrape of the photosensitive body corresponding to an increase in the quantity of the developer or the evaluation of durability in which the image forming operation is actually repeated can be carried out to thereby correspondingly change the setting of the film thickness.

For example, in the case of the present embodiment, if with regard to the photosensitive bodies of the other image forming stations than the Bk image forming station, the film thickness of the charge transporting layer thereof is 15 $\mu$m and the effective film thickness thereof (the difference between the initial film thickness of the charge transporting layer and the film thickness which can be used without any problem in the quality of image) is 5 $\mu$m, the film thickness of the charge transporting layer of the photosensitive drum 401*d* of the developing device 9*d* (Bk) can be set to about 20 $\mu$m.

Also, a lubricating substance such as fluorine particles can be dispersed in the Bk charge transporting layer to thereby improve the sliding property of the surface of the photosensitive body, mitigate the load of the cleaning apparatus and restrain the amount of scrape.

Further, in the present embodiment, the photosensitive bodies 401*a* to 401*d*, the charging apparatuses 402*a* to 402*d*, the developing devices 4*a* to 4*d* and the cleaning apparatuses 405*a* to 405*d* which are the image forming stations for the respective colors are made integral with one another to form the process cartridges 9*a* to 9*c* as shown in FIG. 2 and the process cartridges 9*d* as shown in FIG. 3, but the developing devices 4*a* to 4*d* can singly be made into the form of developing cartridges, or the developing devices 4*a* to 4*d* and the photosensitive bodies 401*a* to 401*d* may be made integral with each other to form process cartridges, whereby they can be made detachably attachable to the in-line color printer which is the image forming apparatus of FIG. 1.

The process cartridges 9*a* to 9*d* in the present embodiment or the cartridges made into the above-described form have means (not shown) for detecting the quantities of remaining developers in the developer containing portions, for example, means for detecting the quantities of remaining developers by a conventional optical detecting method or capacity detecting method, so as to inform the user as a warning for cartridge interchange at predetermined timing that the quantities of remaining toners have become small.

By this warning for interchange, it is possible to provide a period for which the user prepares a cartridge, and when the developer in a cartridge of a certain color has become exhausted, it becomes possible for the user to simply interchange that cartridge to thereby continuedly use the apparatus.

Also, these cartridges are designed to be optimized for their respective lives and therefore, good images free of inconvenience can always be obtained stably until the lives of the cartridges expire.

[Second Embodiment]

A second embodiment in which the image forming apparatus of the present invention is applied to an in-line type color image forming apparatus will now be described with respect chiefly to the differences thereof from the first embodiment.

Figure 5:
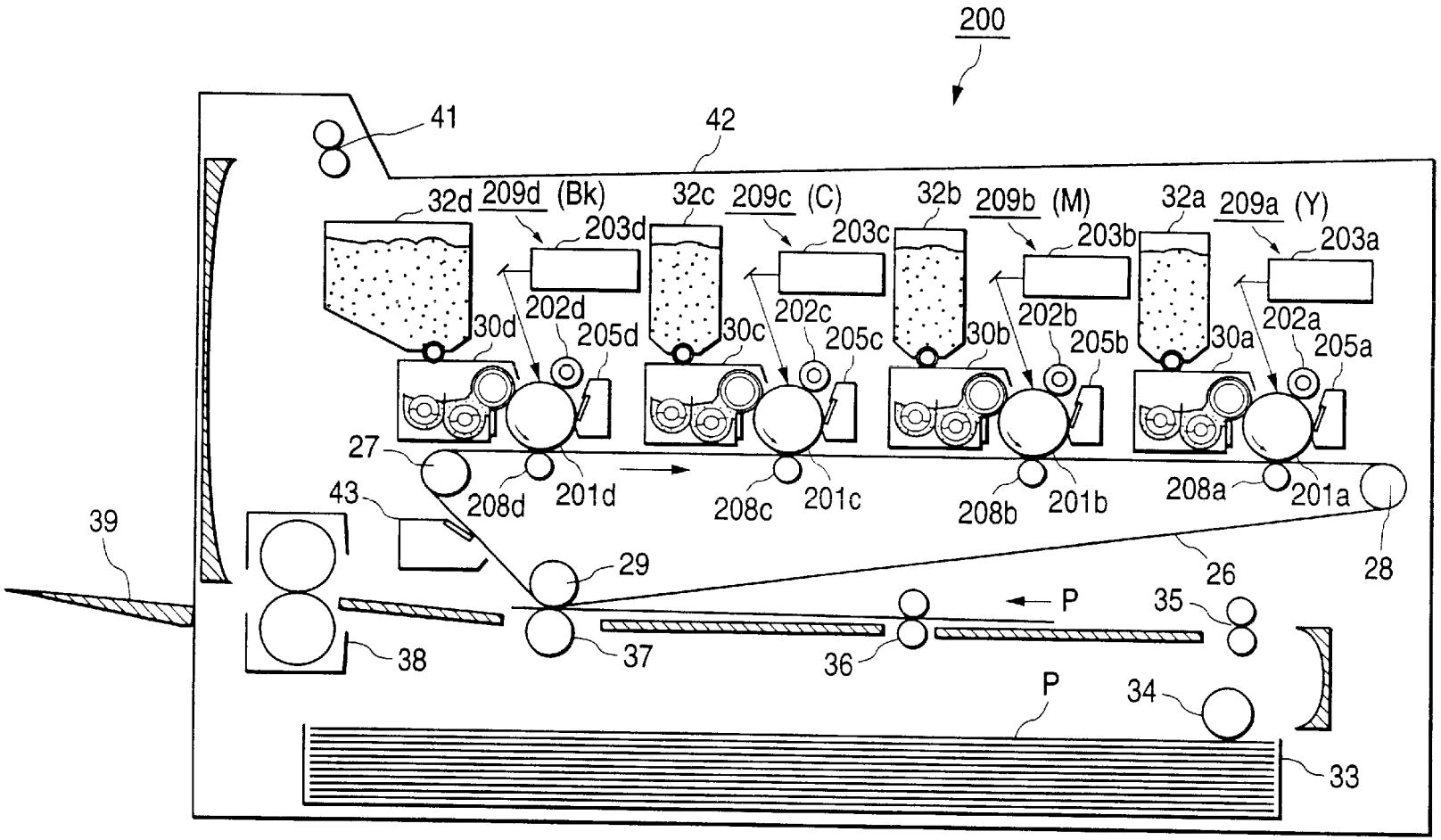
FIG. 5 is a side view schematically showing the main internal structure of an in-line color printer according to a second embodiment of the present invention.

FIG. 5 is a side view schematically showing the main internal structure of the in-line type color image forming apparatus (in-line color printer) according to the present embodiment.

Again in the in-line color printer according to the present embodiment, the basic construction concerned in the image forming operation thereof is substantially the same as that of the aforedescribed prior art (see FIG. 9) and that of the first embodiment (see FIG. 1). Therefore, the constituent members of the present embodiment similar in construction to those of the previous first embodiment need not be described here.

The in-line color printer according to the present embodiment differs from the aforedescribed first embodiment in that it adopts a system whereby developer images formed on image bearing members (photosensitive bodies) are once transferred to an intermediate transferring member, and are further transferred to another transferring member such as recording paper.

That is, as shown in FIG. 5, the in-line color printer 200 is designed such that therein an endless intermediate transferring belt 26 is passed over a driving roller 27, a tension roller 28 and a secondary transferring opposed roller 29 and is rotated in the direction of the arrow.

Image forming stations for forming images of respective colors, i.e., black (Bk), cyan (C), magenta (M) and yellow (Y) are of such construction as shown in FIG. 5 and are provided in series along the conveying direction of the intermediate transferring belt 26.

The image forming means of the image forming stations for the respective colors are comprised of photosensitive drums 201*a* to 201*d*, and charging apparatuses 202*a* to 202*d*, exposing apparatuses 203*a* to 203*d*, developing devices 30*a* to 30*d*, cleaning apparatuses 205*a* to 205*d* and developer supplying devices 50*a* to 50*d* for supplying developers to the developing devices 30*a* to 30*d* which are all disposed around the respective photosensitive drums.

Figure 6:
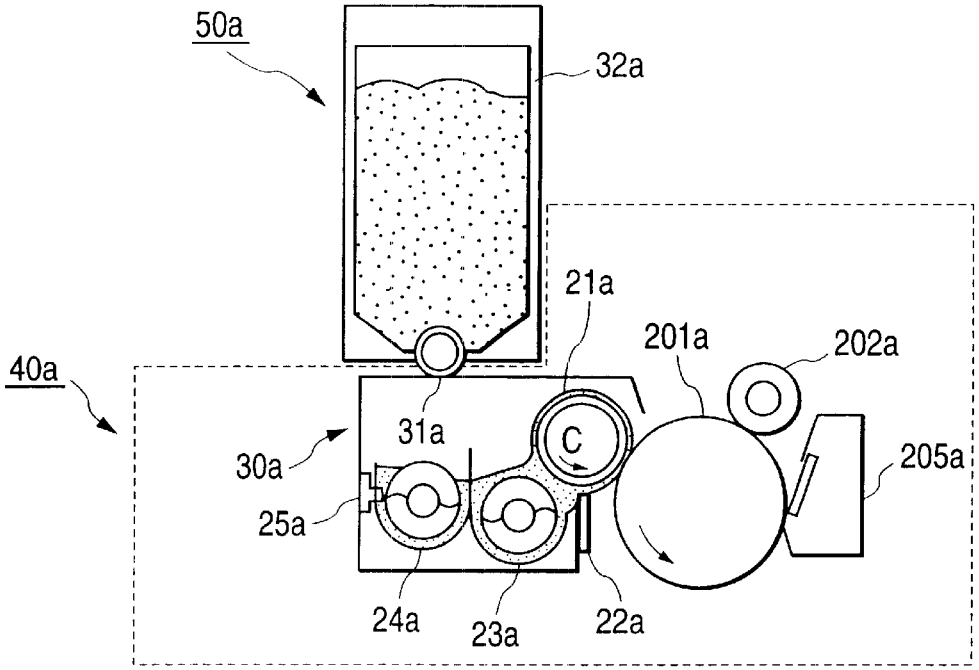
FIG. 6 is a side view showing the process cartridge of the in-line color printer according to the same embodiment on an enlarged scale.
Figure 7:
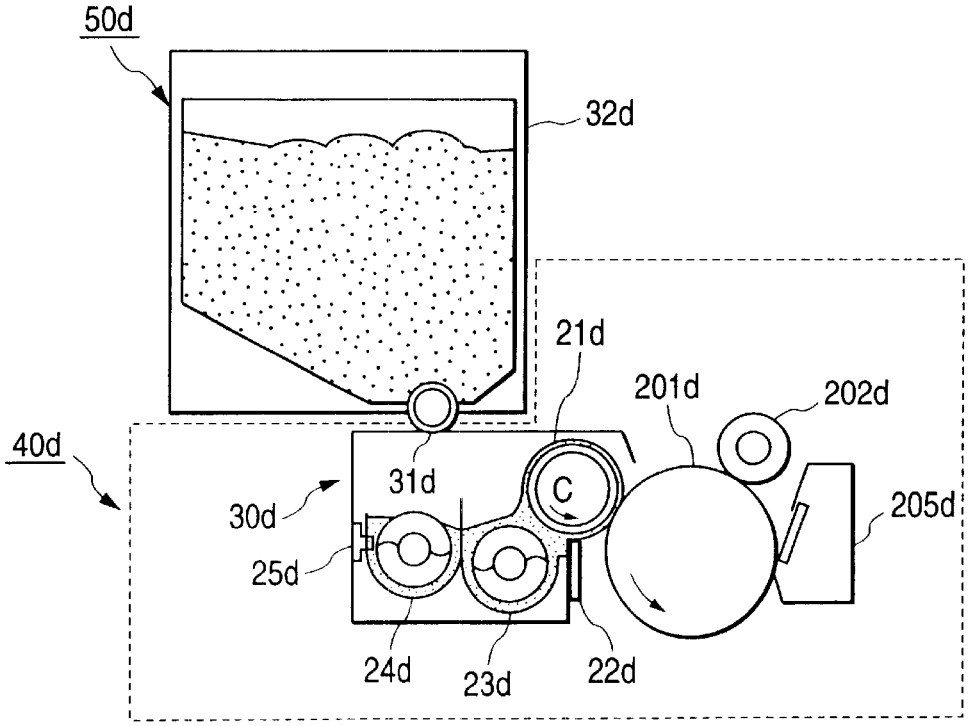
FIG. 7 is a side view showing the process cartridge of the in-line color printer according to the same embodiment on an enlarged scale.

Again in the apparatus according to the present embodiment, the photosensitive drums 201*a* to 201*d*, the charging apparatuses 202*a* to 202*d*, the developing devices 30*a* to 30*d* and the cleaning apparatuses 205*a* to 205*d* which are the image forming means for the respective colors are made integral with one another to form process cartridges 40*a* to 40*c* and 40*d* as shown in FIGS. 6 and 7.

The process cartridges 40*a* to 40*c* and 40*d* in the present embodiment shown in FIGS. 6 and 7 are designed to be detachably attachable to the in-line color printer of FIG. 5.

The image forming operation of the in-line color printer of FIG. 5 will hereinafter be described.

A laser beam modulated in conformity with image data from a host apparatus such as a personal computer from the exposing apparatuses 203*a* to 203*d* to the surfaces of the photosensitive drums 201*a* to 201*d* uniformly charged by the charging apparatuses (charging rollers) 202*a* to 202*d* and is reflected by mirrors, whereby desired electrostatic latent images are obtained for the respective colors. These latent images are reversal-developed and visualized as toner images in developing regions by the developing devices 30*a* to 30*d* containing toners of the respective colors therein disposed in opposed relationship therewith.

In FIG. 5, first in the image forming station for the first color, a Bk toner image formed on the photosensitive drum 201*d* is electrostatically transferred onto the intermediate transferring belt 26 in a primary transferring nip portion with the intermediate transferring belt 26 by a primary transferring apparatus 208*d* such as a tranferring roller which is in contact with and abuts againts the back side of the intermediate transferring belt 26.

Then, in the image forming stations for the second, third and fourth colors, C, M and Y toner images are sequentially transferred from the photosensitive drums 201*c*, 201*b* and 201*a* onto the intermediate transferring belt 26 via a similar process, whereby color toner images are formed.

In the meantime, recording paper P is fed from a transferring member containing portion 33 such as a cassette by a paper feeding mechanism 34 such as a paper feeding roller, and is conveyed to a pair of registration rollers 35. The color toner images formed on the intermediate transferring belt 26 are collectively transferred to the recording paper P once stopped at the registration rollers 35, and thereafter conveyed at predetermined timing through a conveying mechanism 36 or the like and entering from the right as viewed in FIG. 5, in a secondary transferring nip portion with a secondary transferring apparatus 37 such as a transferring roller.

The color toner images thus transferred onto this recording paper P are melted and fixed by a fixing apparatus 38, whereby they are permanently fixed on the recording paper P, and the recording paper is discharged from a paper discharging portion onto a paper discharge tray 39 with its image forming surface facing upwardly. By such a series of operations, a desired color print image can be obtained on the recording paper P.

Also, when the recording paper P is to be outputted with its image forming surface facing downwardly, the recording paper P will be discharged onto a discharge tray 42 by a pair of paper discharging rollers 41 via a predetermined conveying path.

After the secondary transfer, the secondary untransferred toners not transferred but residual on the intermediate transferring belt 26 are removed by an intermediate transferring belt cleaner 43. Also, the primary untransferred toners not transferred but residual on the photosensitive drums 201*a* to 201*d* after the primary transfer are removed by the cleaning apparatuses 205*a* to 205*d* such as cleaning blades, and the photosensitive drums are prepared for the next image forming process.

Here, when a monochrome image of a single color Bk is to be formed, the Y, M and C image forming stations 209*a*(Y), 209*b*(M) and 209*c*(C) do not operate. That is, the above-described image forming operation is performed by only the image forming station 209*d*(Bk) with the intermediate transferring belt 26 and the photosensitive drums 201*a* to 201*c* being spaced apart from each other by a mechanism, not shown.

As the standard for choosing the material of the intermediate transferring belt 26 in the present embodiment, in order to make the registration in each color image forming station good, retractile materials are not preferable, but resin materials or a rubber belt or the like having a metal core therein is preferable. In the present embodiment, use is made of a resin belt formed of polyimide having carbon dispersed therein and controlled to a predetermined volume resistance value.

The developing devices 30*a* to 30*d* and developer supplying containers 32*a* to 32*d* in the present embodiment will now be described with reference to FIGS. 6 and 7.

First, the developing devices 30*a*, 30*b*, 30*c* and 30*d* of Y, M, C and Bk developers are two-component contact developing apparatuses, and are basically substantially the same in construction as the developing devices 4*a* to 4*d* in the first embodiment (see FIGS. 1–4) with the exception that a toner and a carrier which are a developer of each color are contained in each developing device.

Also, the developing devices 30*a*, 30*b*, 30*c* and 30*d* in the present embodiment are of so-called replenishing system type construction, and are designed to be supplied with predetermined quantities of developers at suitable timing from the developer supplying containers 32*a*, 32*b*, 32*c* and 32*d* containing therein developers for replenishment.

The construction of the developing devices 30*a* to 30*d* will hereinafter be described in detail with reference to FIG. 6.

While in FIG. 6, the developing device 30*a* of Y developer is shown, the construction of the developing devices 30*b* to 30*d* of the other colors is also similar and therefore need not be described.

The developing device 30*a* is a two-component magnetic brush developing apparatus and holds a developer comprising a magnetic carrier and a non-magnetic toner on a developing sleeve 21*a* containing a magnet roller therein.

A developer regulating blade 22*a* is provided for the developing sleeve 21*a* with a predetermined gap therebetween, and with the rotation of the developing sleeve 21*a* in the direction of arrow C, a thin layer of the developer is formed on the developing sleeve 21*a*. The developing sleeve 21*a* is disposed so as to have a predetermined gap relative to the photosensitive drum 201*a*, and during development, a predetermined bias voltage is applied with the thin layer of the developer formed on the developing sleeve 21*a* being in contact with the photosensitive drum 201*a*, whereby an electrostatic latent image is developed.

Agitating screws 23*a* and 24*a* for agitating the developer are disposed in the developing device 30*a*, and are rotated in synchronism with the rotation of the sleeve 21*a* and have the function of agitating the supplied toner and carrier and giving predetermined triboelectricity to the toner.

A well-known inductance sensor 25*a* for detecting any change in the magnetic permeability of the developer to thereby detect the toner density (the ratio between the toner and the carrier) in the developer is disposed on the wall surface of the developing device on the upstream side with respect to the agitating direction of the agitating screw 24*a*, and a toner supply opening (not shown) is provided on the downstream side of the sensor 25*a*.

After the developing operation has been performed, the developer is carried to the sensor portion, where the toner density is detected, and in order to maintain the toner density in the developer constant in conformity with the result of the detection, toner supply is effected from within the developer supplying container 32*a* through the intermediary of a toner supplying mechanism 31*a* through the toner supply opening in the developing device 30*a*.

The supplied toner is carried by the screw 24*a* and mixes with the carrier and is given moderate triboelectricity, whereafter it is carried to the vicinity of the sleeve 21*a* and is formed into a thin layer on the developing sleeve 21*a*, and is used for development.

On the other hand, in the image forming apparatus of FIG. 5, units in which the developer supplying containers 32*a* to 32*d* and toner supplying mechanisms 31*a* to 31*d* are made integral with each other form developer cartridges, and are detachably attached to the process cartridges 40*a* to 40*d* are detachably attached to the in-line color printer 200. By applying such a form of cartridges, the user can be prevented from having his or her clothes stained by mistake during the supply of the developers.

Of course, it is also possible to design the developer supplying container 32*a* to be singly detachably attachable to the in-line color printer, and design may be made such that the developer supplying container 32*a* is replenished with the developer from a replenishing bottle.

In the image forming apparatus of FIG. 5, provision is made of means for detecting that the quantity of remaining developer contained in the developer supplying container 32*a* has become small or null by the repetition of the developing operation so that this information may be given as a warning to the display portion (not shown) of the image forming apparatus. By doing so, a period for which the user prepares a developer cartridge can be provided, and the interchange of the cartridge can be done smoothly.

Now, the developer supplying container 32*d* containing Bk developer therein has its volume made large relative to the developer supplying containers 32*a*, 32*b* and 32*c* containing the developers of the other colors therein, and contains about double the amount of developer therein. Thereby, the life of Bk can also be made about double the life of the other colors, and the frequency of the interchange of the developer cartridges becomes reducible.

In the present embodiment, the Bk developer cartridge containing therein a greater quantity of developer than the developers of the other colors and having a relatively large capacity is disposed on the upstream side (the end portion of the conveying path) with respect to the conveying direction of the intermediate transferring belt 26 (transferring member). That is, a construction is adopted in which the Bk developer containing portion and developer cartridge having large configurations are not disposed between the image forming means (on the M image forming station side).

Accordingly, it becomes possible to dispose the photosensitive drums of the respective stations at equal intervals without widening the interval between the respective process cartridges. Therefore, the inconvenience that the intervals among the photosensitive drums becomes non-uniform, whereby such control as the correction of color registration becomes cumbersome does not occur.

Also, by adopting a replenishing system type construction as in the present embodiment, even if the volume of the Bk developer supplying container is made large, the developer is suitably supplied to the developer containing portion and therefore, the aforementioned packing and blocking can be prevented.

[Third Embodiment]

A third embodiment in which the image forming apparatus of the present invention is applied to an in-line type color image forming apparatus will now be described with respect chiefly to the differences thereof from the second embodiment.

Figure 8:
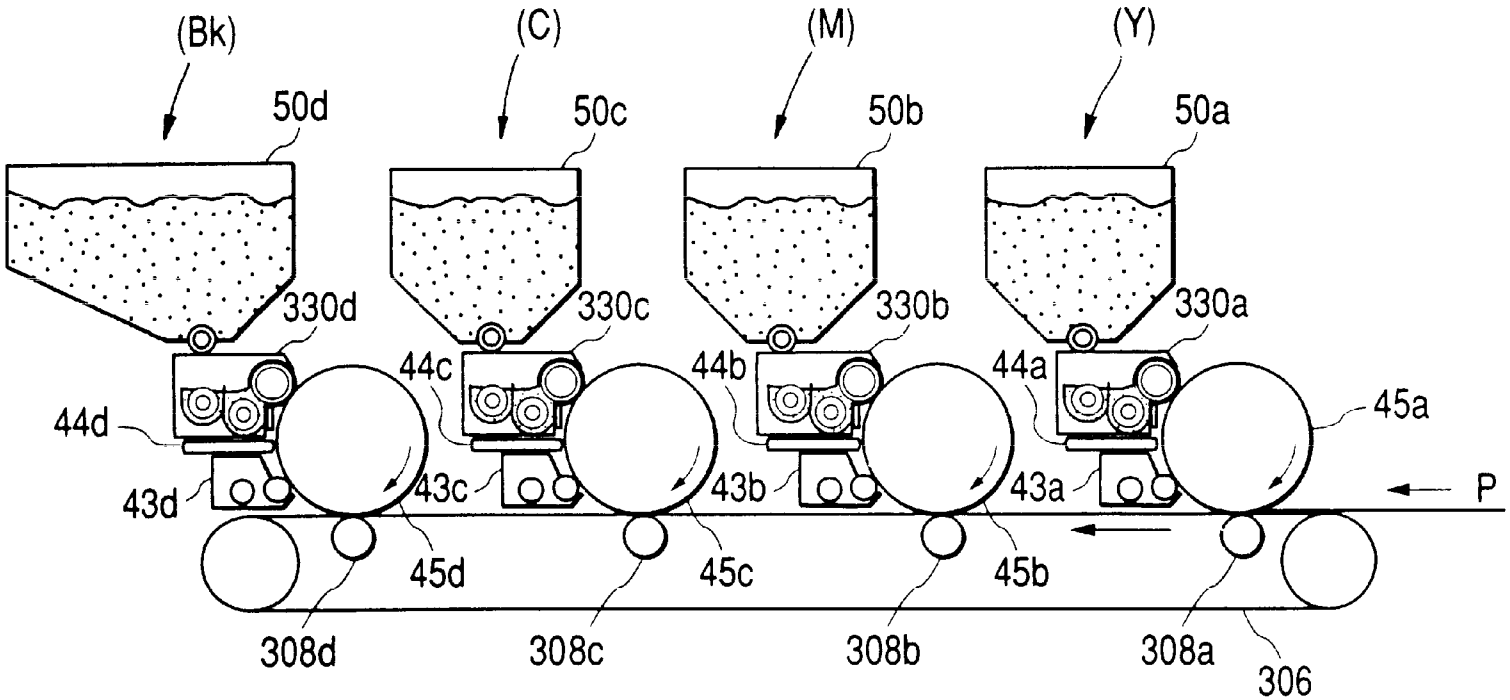
FIG. 8 is a side view schematically showing the main internal structure of an in-line color printer according to a third embodiment of the present invention.

FIG. 8 is a side view schematically showing the main internal structure of the in-line type color image forming apparatus (in-line color printer) according to the present embodiment.

Again in the in-line color printer according to the present embodiment, the basic construction thereof concerned ion the image forming operation is substantially the same as that of the aforedescribed prior art (see FIG. 9), that of the first embodiment (see FIG. 1) and that of the second embodiment (see FIG. 5). Therefore, the constituent members of the present embodiment similar in construction to those of the previous embodiments need not be described here.

The in-line color printer according to the present embodiment is a so-called cleanerless system apparatus using magnetic brush charging apparatuses as charging apparatuses for photosensitive drums, and effecting cleaning simultaneous with developing by developing devices.

The differences of the apparatus according to the present embodiment shown in FIG. 8 from the apparatus according to the second embodiment shown in FIG. 5 will be enumerated below.

Firstly, in the present apparatus, an intermediate transferring belt is not used, but the transferring belt as described in the first embodiment is used to multiplexly transfer images in the order of yellow (Y), magenta (M), cyan (C) and black (Bk) directly to recording paper P in the transferring regions of image forming stations for respective colors.

Secondly, the respective color image forming stations (image forming means) are comprised of photosensitive drums 45*a* to 45*d*, and charging apparatuses 43*a* to 43*d*, LED units 44*a* to 44*d* which are exposing apparatuses, developing devices 330*a* to 330*d* and developer supplying containers 50*a* to 50*d* for supplying developers to the developing devices 330*a* to 330*d* which are all disposed around the photosensitive drums.

Here, the great differences of the present embodiment from the first and second embodiments are that the cleaning apparatuses exclusively on the photosensitive drums are eliminated, and that instead of semiconductor laser units, the LED units 44*a* to 44*d* are applied as mechanisms (exposing apparatuses) for performing the operation of applying information light including the image information to the photosensitive drums, i.e., the so-called exposing operation.

By adopting such construction, it becomes possible to dispose each image forming means at a comer around each photosensitive drum, and the interval of the image forming stations can be made small and the downsizing of the apparatus becomes easy.

The image forming operation of the image forming means (image forming stations) in the present embodiment onto the photosensitive drums will hereinafter be described. Here, only the operation of the Y image forming station will be described, and the image forming stations for the other colors which perform image formation in an operational mode substantially equal thereto need not be described.

First, a magnetic brush charging apparatus using electrically conductive magnetic particles is used as the charging apparatus 43*a*, and an injection charging method of directly injecting charges into the photosensitive body is adopted. Therefore, the photosensitive body 45*a* has an OCL (overcoating layer) composed of tin oxide and teflon dispersed in acrylic resin on the photosensitive layer described in the first embodiment.

Each element corresponding to the resolution of the LED unit (exposing apparatus) 44*a* is ON/OFF-controlled in conformity with image data on the surface of the photosensitive drum 45*a* uniformly charged by the magnetic brush charging apparatus 43*a*, whereby a desired electrostatic latent image is formed. This latent image is reversal-developed in a developing region by a developing device 330*a* (see also FIG. 6) disposed in opposed relationship therewith, and is visualized as a toner image.

In FIG. 8, first in the Y image forming station for the first color, a Y toner image formed on the photosensitive body 45*a* is electrostatically transferred to recording paper P conveyed from the right as viewed in FIG. 8 in a transferring nip portion by a transferring apparatus 308*a*. Color toner images formed by Y, M, C and Bk toner images being multiplexly transferred onto the recording paper P in the named order are melted and fixed by a fixing apparatus, and are permanently fixed on the recording paper, whereby a desired color print image is obtained.

Also, after the transfer, the residual toner on each photosensitive drum which has not been transferred is collected into the developing device by the potential difference between the surface of the photosensitive drum and a bias voltage applied to the developing sleeve, and is reused. That part of the untransferred toner which is charged to the opposite polarity is once introduced into the magnetic brush charging apparatus, but is gradually discharged from that part which has been reversed in polarity and has assumed a normal polarity, and is finally collected into the developing device.

Again in the present embodiment, as in the above-described second embodiment, the Bk developer supplying container 50*d* has its volume made large relative to the other Y, M and C developer supplying containers, whereby the frequency of the interchange of the developer cartridges can be reduced.

In the present embodiment, design is made such that the Bk developer cartridge containing therein a greater quantity of developer than the developers of the other colors is disposed on the most downstream side with respect to the conveying direction of the transferring belt 306, and the Bk developer containing portion and developer cartridge are not disposed at a location corresponding to between two image forming stations (the C image forming station side).

Further, each image forming station is disposed at one side of the photosensitive drum and therefore, the interval of the respective process cartridges can be made small and the photosensitive drums of the respective stations can be disposed at equal intervals and therefore, the downsizing of the apparatus can be realized easily and moreover, such control as the correction of color registration is not made cumbersome.

While in the present embodiment, an in-line type image forming apparatus in which the transferring member is conveyed in a horizontal direction and a plurality of drums are disposed along the conveying path thereof has been described as an example, the present invention can also be applied to an in-line type color image forming apparatus of a construction in which the transferring member is conveyed in a vertical direction and a plurality of drums are disposed along the conveying path thereof.

Also, the form of the process cartridges is not limited to the form in the present embodiment, but cartridges of various types can be adopted. That is, there can be adopted various cartridges of constructions in which a developing device, a charging apparatus, a cleaning apparatus and the like disposed around a photosensitive drum which form each color image forming means are singly or plurally made integral with one another.

Also, the developer containing portion of a large capacity containing the greatest quantity of developer therein may be disposed on at least one of the upstream side of the most upstream photosensitive drum and the downstream side of the most downstream photosensitive drum.

As described in detail above, the image forming apparatuses according to the above-described embodiments achieve the following effects.

In the so-called in-line type image forming apparatus, by a construction in which the intervals among the image forming stations are not widened and are equal to one another, it becomes easy to make the developer capacity of the developing device (in the case of the replenishing system, the developer supplying container) of the image forming means disposed on the most upstream side or the most downstream side with respect to the conveying direction of the transferring member, i.e., at the endmost position on the conveying path, large.

By such construction, the accuracy color registration can be prevented from being aggravated, and the bulkiness of the apparatus can also be restrained.

The black toner is contained in the developing device or the developer supplying container of which the developer capacity is made large, whereby the frequency of the interchange of the Bk developing device higher in the frequency of use than the developing devices of the other colors or the frequency of toner supply can be reduced, and an improvement in maintenance property can be achieved and also, particularly a reduction in the running cost of monochrome print can be achieved.

Also, some of the image forming means or a plurality of mechanisms or apparatuses are made integral with one another to thereby construct a process cartridge, whereby a further improvement in usability can be achieved.

In the manner described above, the developer capacity of the developer containing portion for containing a toner high in the frequency of use is made relative large, whereby the interval of the interchange thereof or developer supply, i.e., the life, can be extended and moreover, the disposition intervals among the successively disposed image forming means are not widened or made non-uniform.

Accordingly, when superimposing the developers of the respective colors on the transferring member to thereby form images of plural colors, fine image formation can be accomplished. That is, it never happens that the accuracy of color registration is aggravated.

Further, the containability of each image forming means in the apparatus is kept suitable and therefore, the bulkiness of the apparatus becomes restrainable.

Particularly, the color of the developer contained in the developer containing portion of which the developer capacity is made large is black, whereby it becomes possible to achieve an improvement in maintenance property and particularly a reduction in the running cost of monochrome print.

What is claimed is:

1. An image forming apparatus comprising:

a plurality of image bearing members for bearing developer images thereon; and a plurality of developer containing portions for containing developer therein and provided correspondingly to respective ones of said plurality of image bearing members;

wherein said developer images can be transferred from said plurality of image bearing members to a transferring member moving along respective transferring positions of said plurality of image bearing members, and of said plurality of developer containing portions, a developer containing portion having a greatest developer containing quantity is provided at least one of upstream of the most upstream one of said plurality of image bearing members and downstream of the most downstream one of said plurality of image bearing members, with respect to a moving direction of said transferring member.

2. An image forming apparatus according to claim 1, wherein said plurality of image bearing members are provided at substantially equal intervals along the moving direction of said transferring member.

3. An image forming apparatus according to claim 1, wherein a thickness of a layer provided on a surface of said image bearing member corresponding to said developer containing portion having greatest developer containing quantity is greater than a thicknesses of layers provided on surfaces of the other image bearing members.

4. An image forming apparatus according to claim 1, wherein said developer containing portion having greatest developer containing quantity contains a black developer therein.

5. An image forming apparatus according to claim 1, wherein said developer containing portion having greatest developer containing quantity is greater in a length thereof in the moving direction of said transferring member than the other developer containing portions.

6. An image forming apparatus according to claim 1, wherein said transferring member is sheet-shaped, and said apparatus has a transferring member carrying member for carrying thereon and conveying said transferring member.

7. An image forming apparatus according to claim 1, further comprising said transferring member, wherein said transferring member is an intermediate transferring member for transferring said developer images from said transferring member to a second transferring member.

8. An image forming apparatus according to claim 1, wherein said plurality of developer containing portions are provided detachably and attachably to a main body of said image forming apparatus.

9. An image forming apparatus according to claim 8, wherein said image bearing members and said developer containing portions corresponding thereto are provided in process cartridges detachably attachable to said main body of said image forming apparatus.

10. An image forming apparatus according to claim 1, wherein respective ones of said plurality of developer containing portions supply the developers to said plurality of image bearing members corresponding thereto.

11. An image forming apparatus according to claim 10, further comprising electrostatic image forming means for forming electrostatic images on said plurality of image bearing members, said electrostatic images being developed with the developers supplied from said plurality of developer containing portions.

12. An image forming apparatus according to claim 1, wherein said plurality of image bearing members are rotatable drums.

13. An image forming apparatus according to claim 1, wherein a direction along the respective transferring positions of said plurality of image bearing members is a substantially horizontal direction.

14. An image forming apparatus according to claim 1, wherein the number of said plurality of image bearing members is at least three.

* * * * *

UNITED STATES PATENT AND TRADEMARK OFFICE

CERTIFICATE OF CORRECTION

PATENT NO. : 6,449,451 B2
DATED : September 10, 2002
INVENTOR(S) : Satoshi Tsuruya et al.

It is certified that error appears in the above-identified patent and that said Letters Patent is hereby corrected as shown below:

Column 3,
Line 20, “recording, paper” should read -- recording paper, --.

Column 4,
Line 39, “great” should read -- greater --.

Column 13,
Line 14, “comer” should read -- corner --.

Column 15,
Line 3, “relative” should read -- relatively --.

Signed and Sealed this

Eleventh Day of February, 2003

JAMES E. ROGAN
*Director of the United States Patent and Trademark Office*